US005964648A

United States Patent [19]

Loth

[11] Patent Number: 5,964,648

[45] Date of Patent: Oct. 12, 1999

[54] CHIPPER KNIFE GRINDING METHOD AND APPARATUS

[75] Inventor: Robert Loth, Lage, Germany

[73] Assignee: B. Maier Zerkleinerungstechnik GmbH, Beilefeld, Germany

[21] Appl. No.: 08/948,339

[22] Filed: Oct. 9, 1997

[30] Foreign Application Priority Data

Oct. 10, 1996 [DE] Germany ..... 196 41 810

[51] Int. Cl.[6] ..... B24B 1/00

[52] U.S. Cl. ..... 451/45; 451/420; 451/419

[58] Field of Search ..... 451/45, 419, 420, 451/421, 422; 409/143, 198; 83/174, 174.1

[56] References Cited

U.S. PATENT DOCUMENTS

| | | | |
|---|---|---|---|
| 2,620,606 | 12/1952 | Dvorak . | |
| 3,643,381 | 2/1972 | Standel . | |
| 4,340,099 | 7/1982 | Lomnicki et al. . | |
| 5,525,094 | 6/1996 | Pallmann . | |
| 5,823,856 | 10/1998 | Pallmann | 451/45 |

FOREIGN PATENT DOCUMENTS

| | | |
|---|---|---|
| 0 626 234 A2 | 3/1994 | European Pat. Off. . |
| 29 32 629 | 2/1981 | Germany . |
| 31 46 433 C2 | 6/1983 | Germany . |
| 43 16 514 C2 | 11/1994 | Germany . |
| 4316514 | 11/1994 | Germany . |

*Primary Examiner*—David A. Scherbel
*Assistant Examiner*—Derris Holt Banks
*Attorney, Agent, or Firm*—Baker & Daniels

[57] ABSTRACT

A method and apparatus for sharpening the knives of a chipper, with the knives remaining in a knife basket during sharpening, and the knife basket being removed from the chipper and placed in a knife basket carrier in which it is rotatably mounted. The knife basket is first locked against rotation, and then a sharpening device, such as a grinding mechanism, is moved in a direction parallel to the knife basket axis along a first knife or group of knives for purposes of sharpening. After sharpening the first knife or group of knives, the knife basket is unlocked and the sharpening device and knife basket are rotated relative to each other, with the sharpening device proceeding to a new working position for sharpening a further knife or group of knives. The above cycle is repeated until all knives have been sharpened. The knife basket is then reinstalled in the chipper.

19 Claims, 3 Drawing Sheets

CHIPPER KNIFE GRINDING METHOD AND APPARATUS

BACKGROUND OF THE INVENTION

The invention relates to a method and apparatus for sharpening the knives of a chipper. Specifically applicable are chippers that produce shreds and chips for subsequent industrial processing, such as raw material for particle board. A significant problem with such chippers is the relatively short service life of the knives. Due to wear, they need to be replaced after only a few hours of operation, that is, several times per shift.

The installation of new, sharp knives involves particular expense. The desired chip thickness depends on the knife overhang beyond the so-called wear plates, which, in turn, are an integral part of the knife rim. It follows that the replacement of dull knives by sharp ones is time-consuming and costly. Labor costs are especially high.

As a result, means have been long-sought to economize the knife replacement. Known from German patent DE 43 16 514 C2 is a method comprising the following steps: First, the knife basket is removed from the chipper and placed in a basket carrier, in which it is mounted rotatably and envelopes a grinding system with a grinding wheel. The dull knives in the basket are first released from their clamping holder, whereupon the knife overhang is adjusted to that needed to allow grinding the knives to a desired working overhang. Next, a slow, continuous rotation is imparted to the knife basket. The grinding system advances simultaneously in the axial direction of the knife basket, and thus along the cutting edges of the knives.

Owing to the continuous and thus uninterrupted rotation of the referenced prior art knife basket, the resulting knife end faces are disposed on a circular arc. It is thus impossible to grind a so-called relief angle. Regarding the relief angle, the referenced patent states that grinding in a built-in state, of necessity, produces a relief angle of zero. Many experts, however, are of the opinion that a relief angle may be desirable.

SUMMARY OF THE INVENTION

The objective underlying the invention is to provide a method and apparatus allowing a flawless, swift and economical sharpening of worn chipper knives and the grinding of exactly positioned cutting edges with a relief angle on the chipper knives. The novel features of the present invention make these and other objectives possible.

One distinguishing advantage of the present invention is that absolutely no relative rotary motion takes place during the individual sharpening operation between the knife basket and the sharpening device. Instead, relative movement between the knives and the sharpening device takes place only in the axial direction. Each individual knife can be sharpened by several reciprocal passes of a grinding wheel. Thus, stock removal can be very precise. As a result, this novel sharpening process allows a relief angle to be produced on each individual knife.

If desired, a grinding mechanism having multiple grinding wheels can be employed, thereby allowing the simultaneous sharpening of a correspondingly large number of knives. Sharpening five, ten or even more knives simultaneously is conceivable. With the sharpening of a knife or knife group completed, the knife basket is indexed to a new position. Alternatively, it would also be possible to keep the knife basket stationary and rotate the sharpening device relative to the knife basket, so that a further knife or further knife group is presented for sharpening.

An applicable sharpening device is a grinding mechanism, which can comprise one or several grinding wheels. With multiple grinding wheels arranged side by side, all wheels are used simultaneously, each grinding a single knife. The grinding wheels may be mounted parallel to one another on the same axis of rotation. But it is also conceivable to mount the grinding wheels of a grinding tool such that they are disposed in radial planes. In such case, each grinding wheel must have a drive shaft of its own.

It is also conceivable to mount the shafts of the grinding wheels such that inclination may be adjusted and different grinding angles can be obtained. This would make the system extremely flexible.

Equivalents to a sharpening system using a grinding mechanism are such sharpening devices using electron discharge machining systems.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Sharpening station 1 is movable relative to the chipper by use of rollers 1.2, such that a knife basket 2 can be received at the chipper and removed from it to the working position of sharpening station 1. In the illustrated exemplary embodiment, a knife basket 2 is placed in sharpening station 1. The knife basket rests on rollers 1.3 so that it can be indexed about its own axis in sharpening station 1.

Figure 2:
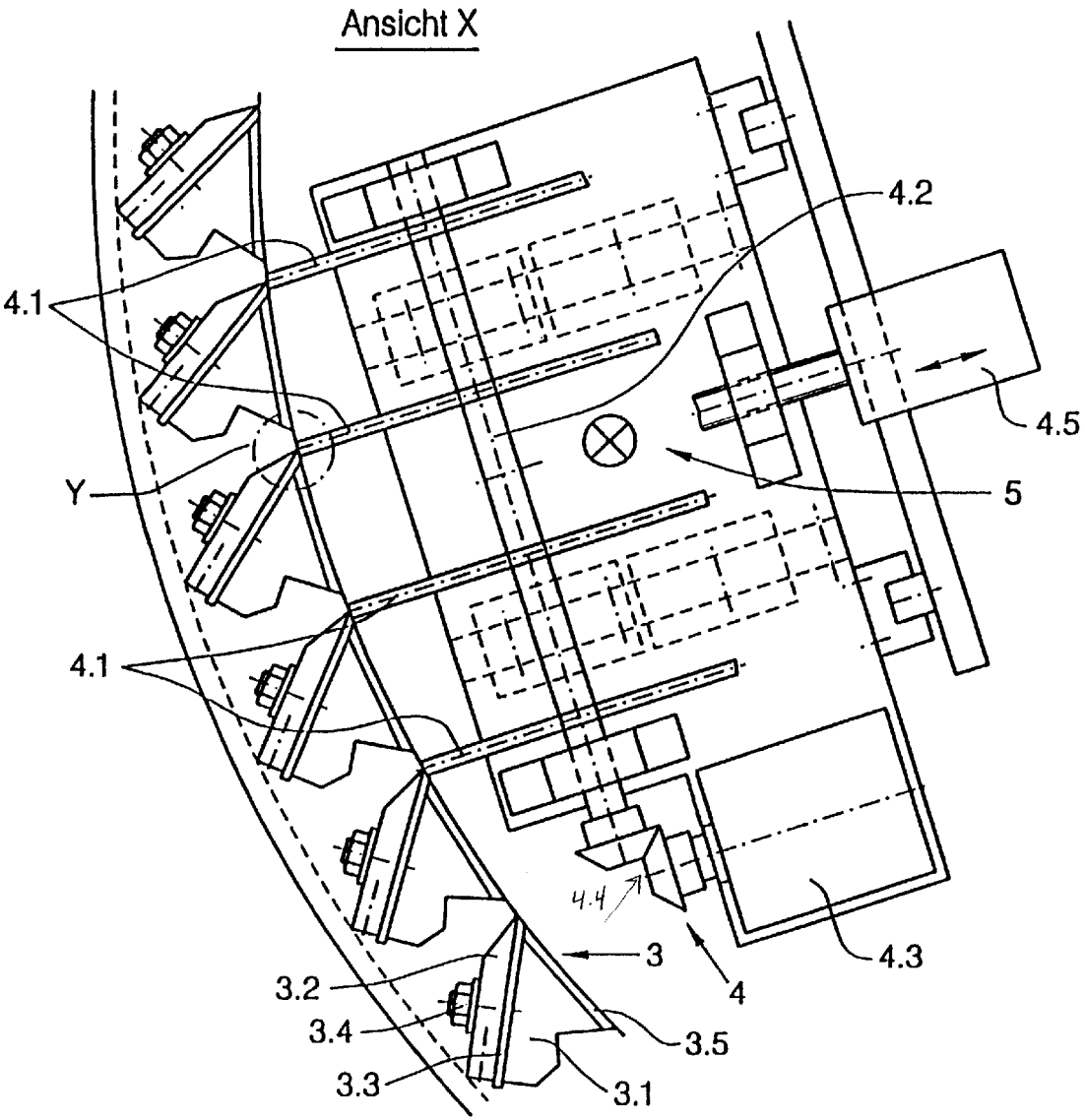
FIG. 2 is an enlarged view of section X of FIG. 1.

Knife basket 2 features a plurality of knife packets 3, which are best seen in FIG. 2. Each packet has support block 3.1, clamping plate 3.2, knife 3.3 contained between, clamping screw 3.4 and wear plate 3.5.

Figure 1:
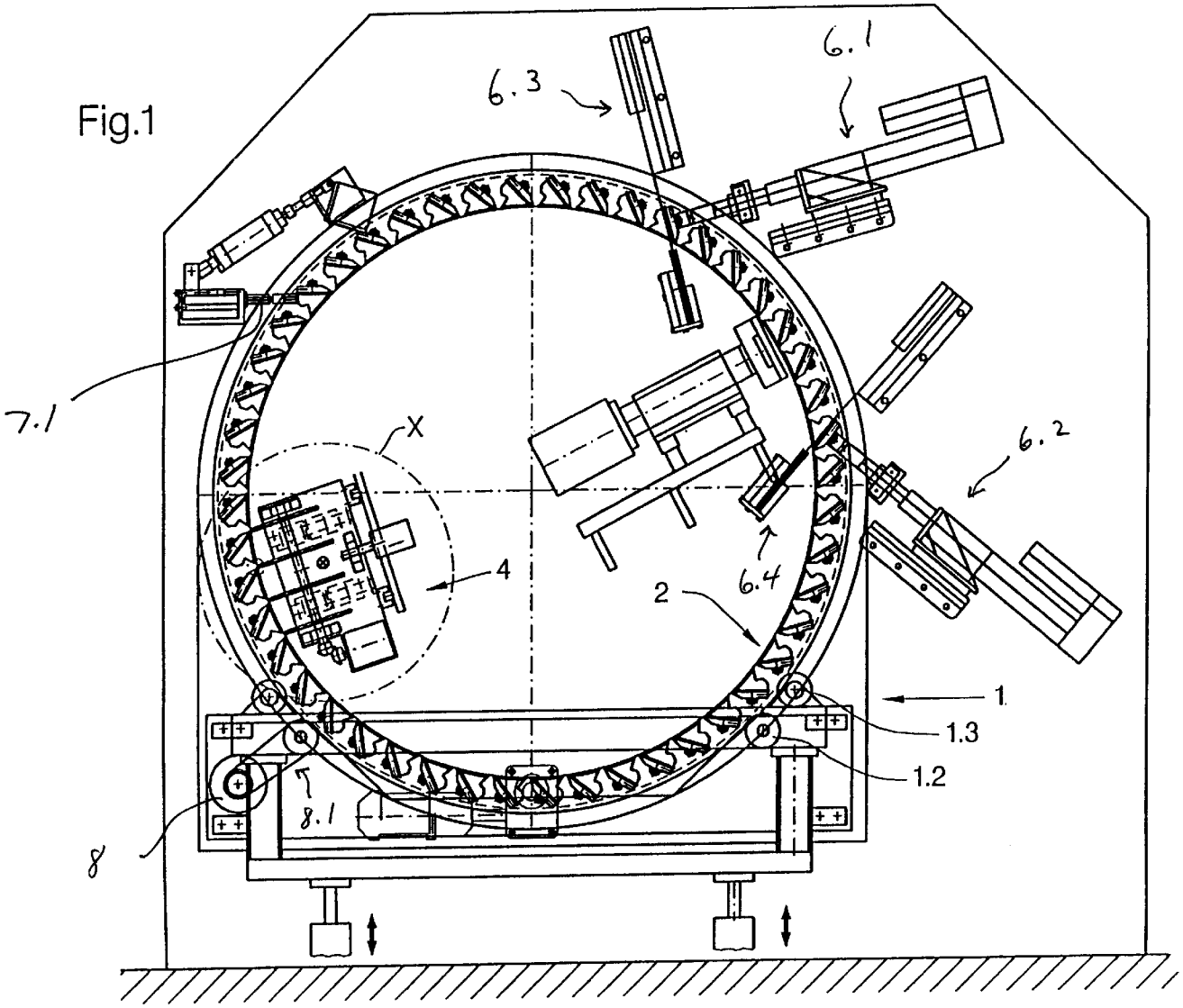
FIG. 1 is a vertical end view of an apparatus for sharpening chipper knives wherein the chipper is not shown.

A primary aspect of the entire apparatus is sharpening device 4, which is shown as a grinding mechanism. Grinding mechanism 4 is shown in FIG. 1 and more completely in FIG. 2. The grinding mechanism can comprise a plurality of grinding wheels 4.1, and is shown as having four such wheels in FIG. 2. The grinding wheels are mounted on a common drive shaft 4.2 driven by motor 4.3 and bevel gearing 4.4. Also illustrated in FIG. 2 is a spindle drive with stepper motor 4.5.

The operating mode of the entire apparatus is as follows:

Once knives 4.1 become dull, the entire knife basket is removed from the chipper by using sharpening station 1. Next, sharpening device 4, such as a grinding mechanism as shown in FIG. 2. supported for axial movement by conventional structure, is introduced in the interior circumscribed by knife basket 2. The grinding mechanism is positioned such that each grinding wheel 4.1 opposes a knife 3.3, which is to be ground. The knife basket 2 can be locked against rotation by means of a shiftable bolt (not shown) that can be hydraulically or manually actuated, and which is inserted into the space between two adjacent knife packets 3 and then withdrawn for unlocking. Alternatively, a hydraulically actuated rod 7.1 can engage one of the knife packets. Drive motor 4.3 imparts rotation to grinding wheels 4.1 through bevel gearing 4.4 and drive shaft 4.2, while stepper motor 4.5 runs the entire unit in the direction of the double arrow (to the left as shown in FIG. 2) so that the peripheral faces of grinding wheels 4.1 make contact with the faces of the knives 3.3, which are to be ground.

The distinguishing advantage is that no rotary motion of the knife basket relative to the grinding mechanism takes place during the sharpening of a knife or a group of knives.

There is a further drive provided, of which the location of shaft 5 is illustrated symbolically in FIG. 2. Shaft 5 could be a threaded lead screw supported by external structure. This drive produces a movement of sharpening device 4 parallel to the axis of knife rim 2 and simultaneously parallel to the cutting edges of knives 3.3. The sharpening of each knife may be completed with a single reciprocation of sharpening device 4. But it is also possible to perform two or more movements in one and the other direction.

Before a knife 3.3 is ground, screws 3.4 clamping the knife 3.3 in place are loosened, knife 3.3 is pushed slightly inwardly of the basket 2 and screws 3.4 are tightened. The knife 3.3 is now in a position for grinding. After knife 3.3 has been ground, screws 3.4 are again loosened, the radial position of the knife is adjusted and screws 3.4 retightened. If desired, this can be accomplished automatically by means of screwing and unscrewing mechanisms 6.1 and 6.2 and knife pushing mechanisms 6.3 and 6.4.

It is to be understood that sharpening device 4, shown as a grinding mechanism in FIG. 2., may feature a number of grinding wheels 4.1 other than the four grinding wheels shown in FIGS. 1 and 2. For example, a single grinding wheel may be provided, or alternatively, more than four grinding wheels may be provided.

Moreover, it is possible to mount grinding wheels 4.1 such that they extend in radial planes, thus extending through the center of knife basket 2. This is possible while using a single grinding wheel per grinding mechanism 4 as well as for a grinding mechanism 4 having a plurality of grinding wheels.

Figure 3:
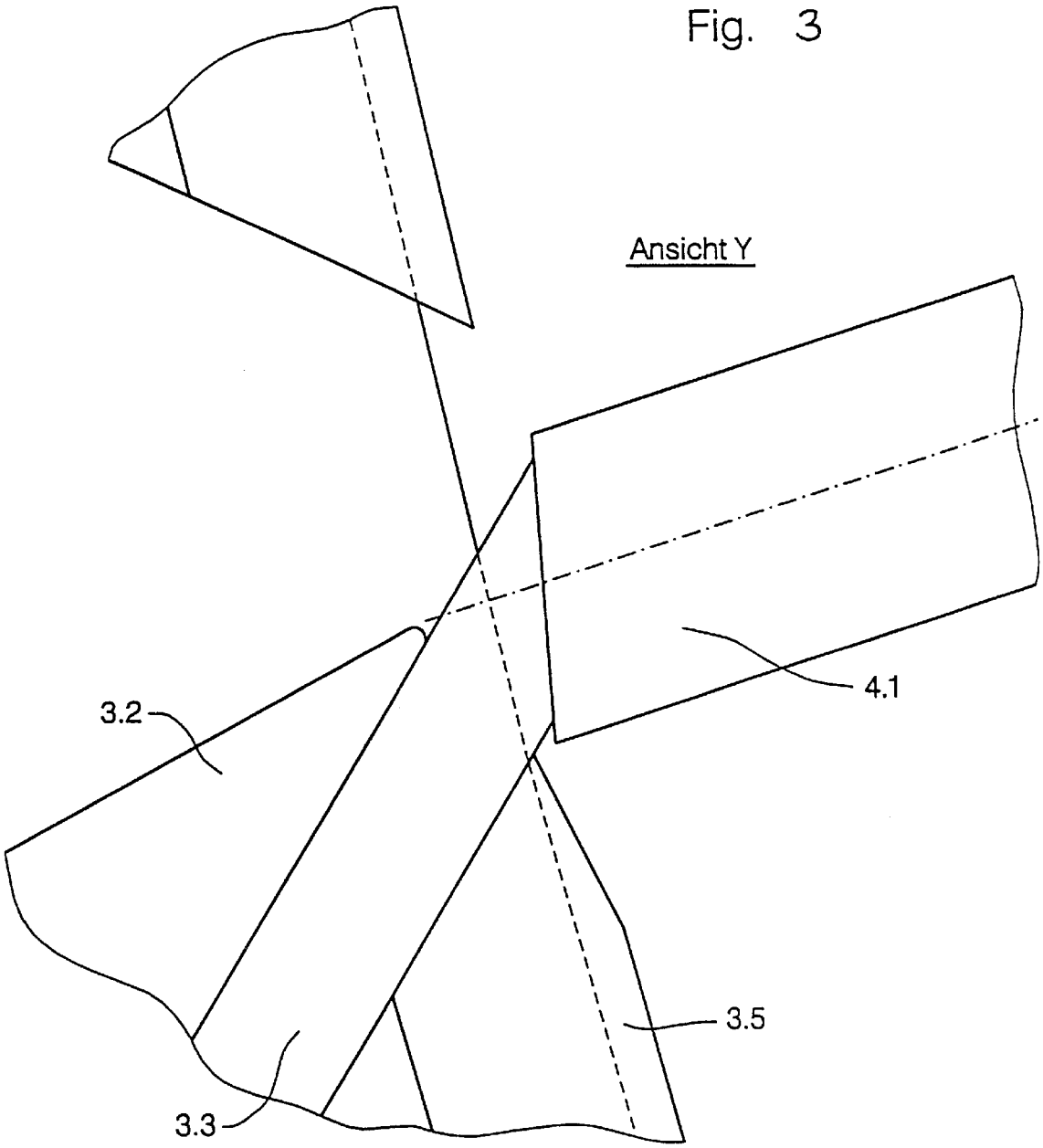
FIG. 3 is an enlarged view of section Y of FIG. 2.

It is also conceivable to change the inclination of individual grinding wheels 4. 1, thereby allowing a variable angle to be ground to knife 3.3. As illustrated in FIG. 3, a relief angle can be ground with the grinding wheel 4.1 to the knives 3.3.

Once grinding of one set of knives has been completed, knife basket 2 can be indexed to the next position by any suitable mechanism, such as stepper motor 8 and belt and roller mechanism 8.1.

While this invention has been described as having a preferred design, the present invention can be further modified within the spirit and scope of this disclosure. This application is therefore intended to cover any variations, uses, or adaptions of the invention using its general principles. Further, this application is intended to cover such departures from the present disclosure as come within known or customary practice in the art to which this invention pertains and which fall within the limits of the appended claims.

What is claimed is:

1. A method for sharpening knives of a chipper, the knives remaining in a knife basket during sharpening, the knife basket being removed from the chipper and rotatably mounted in a knife basket carrier, said knife basket having an axis, said method comprising:

locking the knife basket against rotation;

moving a sharpening device in a direction parallel to the knife basket axis along at least one first knife for sharpening, the sharpening device and the knife basket being stationary relative to each other in a circumferential direction about the knife basket axis;

unlocking the knife basket and the sharpening device relative to each other, rotating the sharpening device and the knife basket relative to each another, the sharpening device proceeding to a new working position for sharpening a further knife;

continuing the cycle of unlocking the knife basket and the sharpening device relative to each other and rotating the sharpening device and knife basket relative to each another until all knives have been sharpened; and reinstalling the knife basket in the chipper.

2. The method of claim 1, wherein sharpening the knives is done by grinding.

3. The method of claim 2, wherein grinding is done by a grinding mechanism.

4. The method of claim 3, wherein prior to grinding the knives, a working face of the grinding mechanism is positioned relative to a cutting edge of the respective knife such that a relief angle is ground.

5. The method of claim 4, wherein the grinding mechanism is at least one grinding wheel.

6. The method of claim 4, wherein the grinding mechanism comprises a plurality of grinding wheels.

7. The method of claim 3, wherein the grinding mechanism is at least one grinding wheel.

8. The method of claim 3, wherein the grinding mechanism comprises a plurality of grinding wheels.

9. Apparatus for sharpening knives of a chipper, the knives remaining in a knife basket during sharpening, the knife basket having an axis, the apparatus comprising:

a knife basket carrier in which said knife basket can be placed and rotatably mounted upon removal from the chipper;

a locking device securing said knife basket against rotation about the knife basket axis;

a sharpening device;

said sharpening device reciprocable in a direction parallel to the knife basket axis and along said knives for purposes of sharpening said knives;

said sharpening device and said knife basket rotatable relative to each other about the knife basket axis, allowing indexing of said sharpening device to a new working position after sharpening at least one of said knives.

10. The apparatus of claim 9, wherein said sharpening device comprises a grinding mechanism.

11. The apparatus of claim 10, wherein said grinding mechanism further comprises a plurality of grinding wheels, each of said grinding wheels aligned with one of said knives and making contact in a working position, each of said grinding wheels having a working face contacting a respective one of said knives.

12. The apparatus of claim 11, wherein each of said grinding wheels has its own drive shaft.

13. The apparatus of claim 12 wherein each of said grinding wheels is disposed in a radial plane.

14. The apparatus of claim 11, wherein said grinding wheels are mounted on a single drive shaft.

15. The apparatus of claim 10, wherein a working face of said grinding mechanism can be positioned relative to cutting edges of said knives such that a relief angle is ground.

16. The apparatus of claim 15, wherein said grinding mechanism comprises a plurality of grinding wheels, each of said grinding wheels aligned with one of said knives and making contact in a working position, each of said grinding wheels having a working face contacting one of said knives.

17. The apparatus of claim 16, wherein each of said grinding wheels has its own drive shaft.

18. The apparatus of claim 17 wherein each of said grinding wheels is disposed in a radial plane.

19. The apparatus of claim 16, wherein said grinding wheels are mounted on a single drive shaft.

* * * * *